US006196789B1

(12) United States Patent
McEwen et al.

(10) Patent No.: US 6,196,789 B1
(45) Date of Patent: Mar. 6, 2001

(54) COMPRESSOR

(75) Inventors: Jim A. McEwen, Brighouse; Paul Brierley, Huddersfield; David J. Gee, Sheffield; W. Kenneth Bruffell, Mirfield, all of (GB)

(73) Assignee: Holset Engineering Company, Huddersfield (GB)

( * ) Notice: Subject to any disclaimer, the term of this patent is extended or adjusted under 35 U.S.C. 154(b) by 0 days.

(21) Appl. No.: 09/184,737

(22) Filed: Nov. 2, 1998

(51) Int. Cl.[7] ..... F04D 29/42
(52) U.S. Cl. ..... 415/58.4; 415/119; 415/914
(58) Field of Search ..... 415/58.2, 58.3, 415/58.4, 119, 208.1, 214.1, 914; 29/888.021, 888.025

(56) References Cited

U.S. PATENT DOCUMENTS 4,930,979 * 6/1990 Fisher et al. ..... 415/58.4

FOREIGN PATENT DOCUMENTS

1368497 * 1/1988 (RU) ..... 415/58.4

* cited by examiner

*Primary Examiner*—Edward K. Look
*Assistant Examiner*—Liam McDowell
(74) *Attorney, Agent, or Firm*—Gary M. Gron

(57) ABSTRACT

An MWE compressor comprising a housing defining an inlet and an outlet, and an impeller wheel rotatably mounted in the housing such that on rotation of the wheel gas within the inlet is moved to the outlet. The housing has an inner wall defining a surface located in close proximity to radially outer edges of vanes supported by the wheel. The inlet is defined by a first tubular portion an inner surface of which is an extension of the said surface of the inner wall of the housing, a second tubular portion located radially outside the first portion to define an annular passage between the first and second portions, a wall extending across the annular passage between the first and second portions, and a conical wall located upstream of the first portion and extending in the radially outwards and upstream directions from adjacent the upstream end of the first portion to the upstream end of the second portion. At least one aperture is defined between the downstream end of the conical wall and the upstream end of the first tubular portion to communicate with the annular passage. At least one aperture is defined adjacent the wheel in the surface of the inner wall of the housing to communicate with the annular passage. The apertures are located on opposite sides of the wall extending across the annular passage, and at least one further aperture is provided in that wall.

12 Claims, 9 Drawing Sheets

COMPRESSOR

TECHNICAL FIELD

The present invention relates to a compressor and in particular to a compressor having an inlet structure the characteristics of which are such that noise levels external to the structure are reduced as compared with conventional inlet structures.

BACKGROUND OF THE INVENTION

Turbochargers have been designed which incorporate a compressor inlet structure that has become known as a "map width enhanced" (MWE) structure. Such an MWE structure is described in for example U.S. Pat. No. 4,930,979. In such arrangements, the compressor inlet comprises two coaxial tubular inlet sections, the inner inlet section being shorter than the outer section and having an inner surface which is an extension of a surface of an inner wall of the compressor housing which faces vanes defined by an impeller wheel mounted within the housing. An annular flow path is defined between the two tubular inlet sections, the annular flow path being open at the upstream end and opening at the downstream end through apertures communicating with the inner surface of the housing which faces the impeller wheel.

With an MWE inlet structure, when the flow rate through the compressor is high, air passes axially along the flow path defined between the two tubular sections towards the compressor wheel. When the flow through the compressor is low, the direction of air flow through the flow path is reversed so that air passes from the apertures adjacent the impeller wheel to the upstream end of the inner tubular section of the inlet structure. As is well known, the provision of such a flow path stabilises the performance of the compressor.

It is well known that compressors incorporating MWE inlet structures tend to exhibit higher levels of noise than conventional structures in which an inlet is defined by a single tubular member. This problem is addressed in British patent number 2256460 which disloses an MWE inlet which incorporates a noise-reduction baffle located upstream of the inner tubular section of the structure and retained within the upstream end of the outer tubular section of the structure. The baffle thus closes off the otherwise open axial end of the annular flow path defined between the inner and outer tubular sections of the inlet structure, the flow path communicating with the inlet through slots defined between the baffle and the upstream end of the inner tubular section of the inlet structure. The baffle may incorporate a conical section expanding outwards from the slots adjacent the upstream end of the inner tubular section of the structure.

The provision of a cone shaped baffle of the form illustrated in British patent 2256460 does reduce the noise emitted from the annular flow path defined between the two tubular sections of the structure and generally results in a reduction in the overall noise level. In some operational circumstances however the noise level within the main inlet flow passage is increased.

It is an object of the present invention to provide an improved MWE structure which addresses the noise problems referred to above.

SUMMARY OF THE INVENTION

According to the present invention, there is provided a compressor comprising a housing defining an inlet and an outlet, and an impeller wheel rotatably mounted in the housing such that on rotation of the wheel gas within the inlet is moved to the outlet, the housing having an inner wall defining a surface located in close proximity to radially outer edges of vanes supported by the wheel, wherein the inlet is defined by a first tubular portion an inner surface of which is an extension of the said surface of the inner wall of the housing, a second tubular portion located radially outside the first portion to define an annular passage between the first and second portions, and a wall extending across the annular passage between the first and second tubular portions, the wall being located between upstream and downstream ends of the first tubular portion, sections of the passage on opposite sides of the wall communicating through at least one aperture, and at least one aperture being defined adjacent the wheel in the said surface of the inner wall of the housing to communicate with the annular passage.

The wall which extends across the annular passage suppresses the propagation of noise along the annular passage. Preferably the wall is located at or adjacent the position of an anti-node of a noise wave which may be expected to propagate along the annular passage during normal use of the compressor. The wall may be in the form of a simple radially extending flange, or alternatively may extend in a direction inclined to the radial direction, and may be shaped to define a helix or other configuration with an axial component.

The inlet may comprise a wall defining an annular surface facing the annular passage and extending outwards from adjacent the upstream end of the first tubular portion to the upstream end of the second tubular portion, an aperture being defined between the upstream end of the first tubular portion and the radially inner edge of the annular surface. The annular surface may be frusto-conical, and may extend in the radially outwards and upstream direction from adjacent the upstream end of the first tubular portion.

Preferably the inlet comprises a wall defining a tubular surface extending in the upstream direction from adjacent the upstream end of the first tubular portion. Such a structure ensures that noise propagating in the upstream direction along the inlet is subjected to a rapid expansion at the upstream end of the tubular surface. This further reduces the noise output.

The wall extending across the annular passage may be in the form of a flange extending radially outwards from the first tubular portion, at least one aperture being defined in radially outer portions of the flange adjacent the second tubular portion.

At least the first tubular portion and the wall extending across the annular passage may be defined by a sub-assembly which is received within the second tubular portion. The sub-assembly may be retained in position within the second tubular portion by engagement between radially outer sections of the wall defining an annular surface and indentations defined within the second tubular portion.

The invention also provides a compressor comprising a housing defining an inlet and outlet, and an impeller wheel rotatably mounted in the housing such that on rotation of the wheel gas within the inlet is moved to the outlet, the housing having an inner wall defining a surface located in close proximity to radially outer edges of vanes supported by the wheel, wherein the inlet is defined by a first tubular portion an inner surface of which is an extension of the said surface of the inner wall of the housing, a second tubular portion located radially outside the first portion to define an annular passage between the first and second portions, a wall defining a surface facing the annular passage and extending from adjacent the upstream end of the first tubular portion to the upstream end of the second tubular portion, and a wall defining a tubular surface extending axially in the upstream direction from the upstream end of the first tubular portion, at least one first aperture being defined between the downstream end of the wall defining the tubular surface and the upstream end of the first tubular portion to communicate with the annular passage, at least one second aperture being defined adjacent the wheel in the said surface of the inner wall of the housing to communicate with the annular passage, and the surface facing the annular passage being inclined to the radial direction.

SUMMARY OF THE DRAWINGS

An embodiment of the present invention will now be described, by way of example, with reference to the accompanying drawings, in which.

DESCRIPTION OF THE INVENTION

Figure 1:
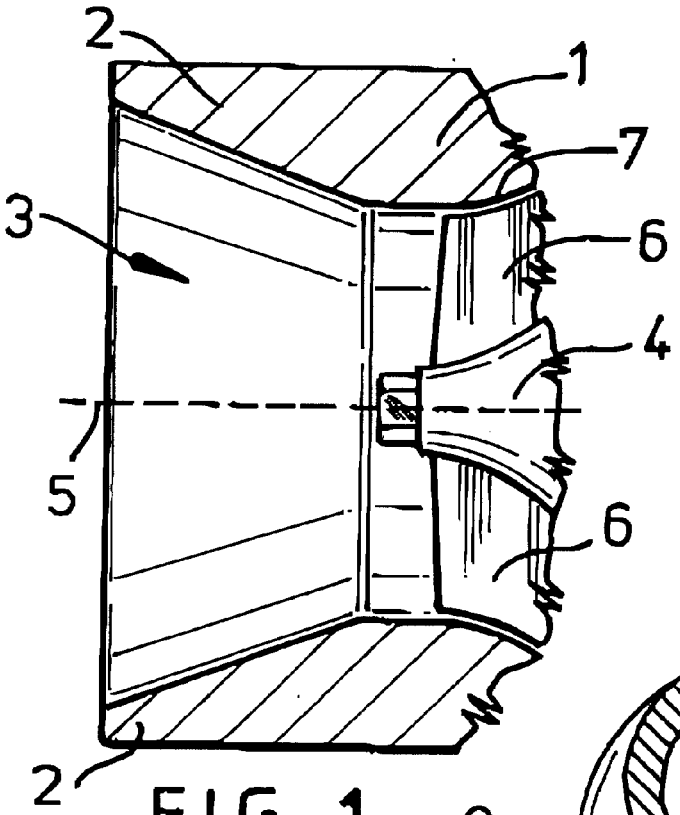
FIG. 1 is a schematic sectional view through a conventional inlet section of a turbocharger compressor.

Referring to FIG. 1, the illustrated conventional inlet section of a compressor is not provided with a map width enhanced structure. The illustrated structure comprises a housing 1 a tubular inlet portion 2 of which defines an inlet passage 3 which tapers in the downstream direction. The inlet communicates with a cavity defined within the housing 1 within which an impeller wheel 4 is mounted to rotate about an axis indicated by broken line 5. The wheel 4 supports vanes 6 the radially outer edges of which sweep across an inner surface 7 defined by the housing 1.

As is well known, the conventional structure illustrated in FIG. 1 is unstable in certain operating conditions and in particular only operates satisfactorily over a relatively limited range of impeller wheel flows. It is known to overcome this problem by providing an MWE inlet structure of the type shown in FIG. 2.

Figure 2:
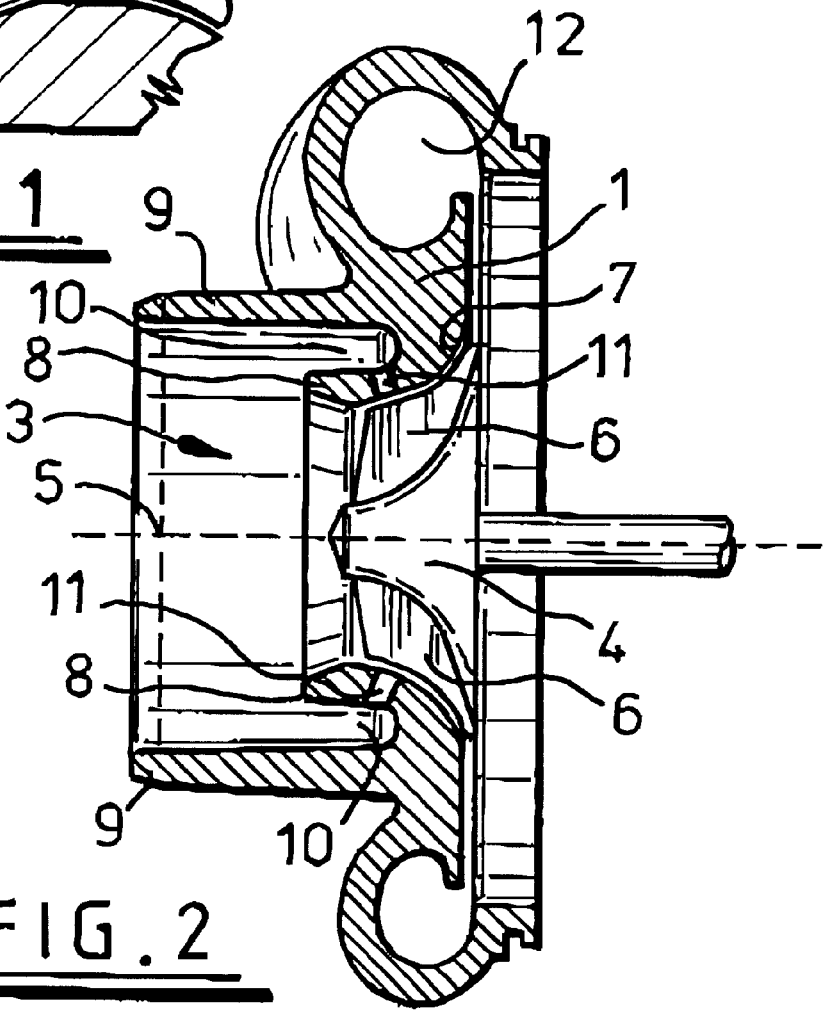
FIG. 2 is a schematic sectional view of an inlet section of a known compressor provided with a map width enhanced inlet.

Referring to FIG. 2, the same reference numerals are used as in FIG. 1 where appropriate. The inlet structure illustrated in FIG. 2 comprises a tubular first portion 8 an inner surface of which is an extension of the inner housing surface 7 and a tubular second portion 9 which is located radially outside the first portion 8 to define an annular passage 10 between the first and second portions. Apertures 11 are formed through the housing at the downstream end of the tubular first portion 8, the apertures opening into the surface 7 defined by the housing. The radially outer edges of the vanes 6 sweep across the surface 7 in which the apertures 11 are formed.

When the wheel 4 rotates, air is drawn in through the inlet passage 3 and delivered to a volute 12. If the wheel 4 rotates at a high speed and flow condition, air is drawn into the housing through the tubular first inlet portion 8 and through the annular passage 10 and apertures 11. As the mass flow through the impeller wheel 4 falls however the pressure drop across the apertures 11 falls and eventually reverses, at which time the air flow direction in the annular passage 10 also reverses such that some of the air entering the housing though the tubular first inlet portion 8 is re-circulated via the annular passage 10. In a well known manner this stabilises the operation of the input stage of the compressor.

Figure 3:
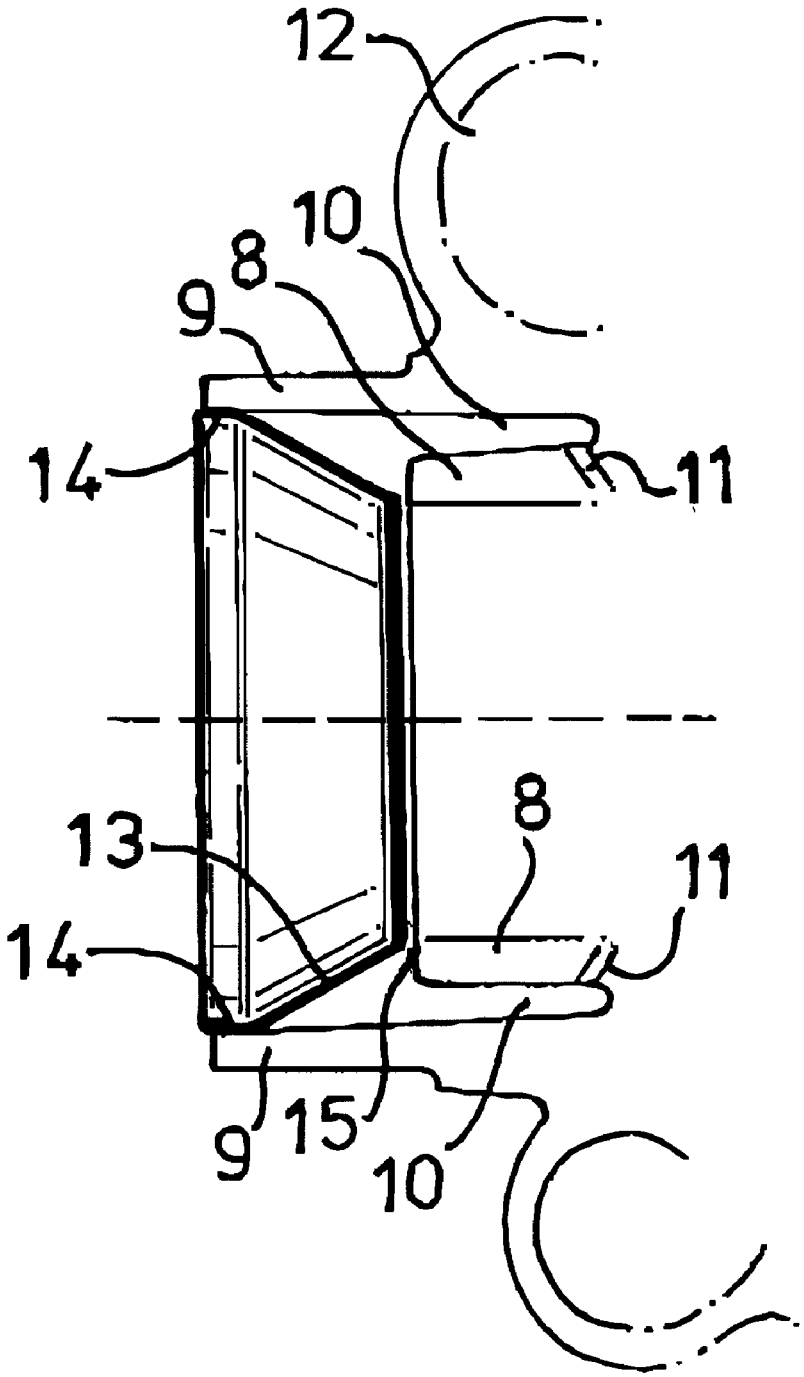
FIG. 3 is a schematic part-sectional illustration of a known compressor inlet section incorporating a noise-reducing baffle.
Figure 4:
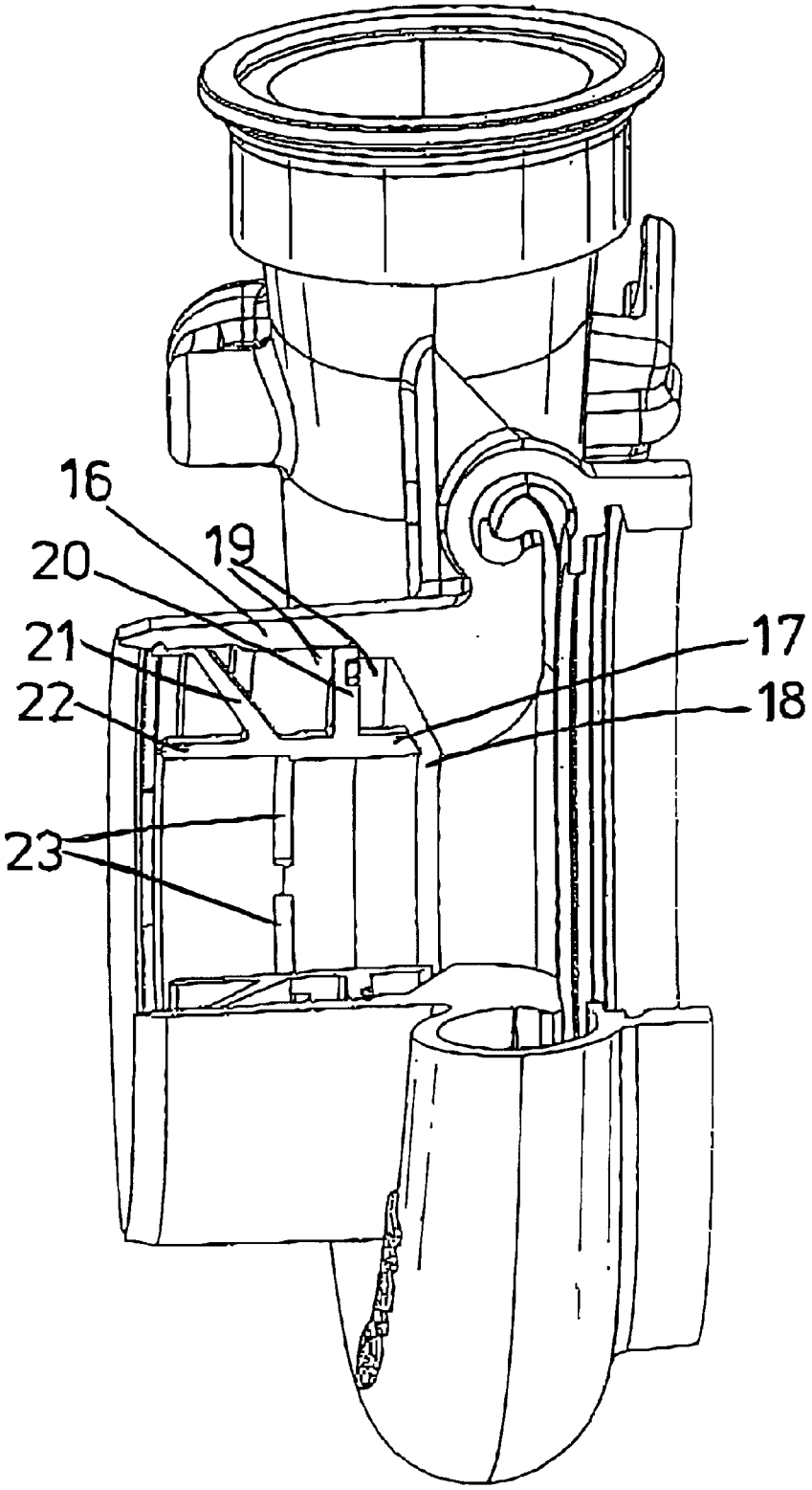
FIG. 4 is a part-sectional illustration of a compressor housing in accordance with the present invention.

Referring to FIG. 3, the illustrated inlet structure is as described in FIG. 14 of published British patent specification number 2256460. The structure of FIG. 3 is generally similar to that of FIG. 2 except for the addition of a baffle located upstream of the tubular first portion 8 within the tubular second portion 9. The baffle is a frusto-conical annular structure defining a conical surface 13 and a tubular portion 14 which is a tight fit within the tubular second portion 9 of the inlet structure. A slot 15 is defined between the downstream end of the tubular surface 13 and the upstream end of the tubular first portion 8 of the inlet structure.

Given the arrangement illustrated in FIG. 3, pressure wave fronts propagating through the apertures 11 in the annular passage 10 break out through the slot 15 into the relatively high velocity air stream entering the tubular first portion 8 of the inlet structure. As a result the overall output of noise from the assembly is reduced. Noise output is also reduced due to the changes in direction of movement of the air stream passing through the annular passage 10. It has been found however that with the known structure of FIG. 3, although the noise output is less than that with the conventional MWE structure as illustrated in FIG. 2, it is still greater than the noise output of the conventional non-MWE structure illustrated in FIG. 1.

Referring now to FIGS. 4, 5, 6 and 7, the structure of a first embodiment of the present invention will be described. The illustrated embodiment comprises a tubular first portion 16 within which a moulded plastics assembly is received, that assembly incorporating elements which make up second, third, fourth and fifth portions of the overall assembly. The second portion is in the form of a tubular portion 17 extending in the upstream direction from adjacent a slot 18, the functional purpose of the slot 18 being the same as that of the slot 11 as described above with reference to FIGS. 2 and 3. An annular passage 19 is defined between the tubular first portion 16 and the tubular second portion 17. The third portion is in the form of a wall 20 which extends radially outwards from the tubular second portion 17 across the passage 19. The fourth portion is in the form of a frusto-conical wall 21 which extends in the radially outwards and upstream directions from the upstream end of the tubular second portion to an inner surface of the tubular first portion 16. The angle of inclination of the wall 21 relative to the radial direction could be reversed such that the surface extends in the radially outwards and downstream directions. In both cases, the frusto-conical surface suppresses noise across a range of frequencies. If the wall was radial, noise suppression would occur only at one frequency. The fifth portion is in the form of a tubular extension 22 of the tubular second portion 17. Slots 23 are formed between the tubular second and fifth portions, the slots 23 performing the function of the slot 15 as described with reference to FIG. 3 above.

The wall 20 extends only part way across the annular passageway 17 but supports four lugs 24 which bear against the inner surface of the tubular first portion 16. Thus the tubular passageway 19 is divided into two separate sections located on opposite sides of the wall 20, the wall being in effect apertured as a result of the four slots defined between each adjacent pair of lugs 24. Thus air flows through the annular passageway 19 between the slots 18 and 23 via the apertures defined in the wall 20. The direction of flow of air through the annular passageway 19 is a function of the flow rate through the inlet structure as a whole as is the case with any conventional MWE inlet structure.

The radially outer end of the conical fourth portion 21 supports four lugs 25 which define radially projecting ribs that are received in an annular groove formed within the tubular first portion 16.

Figure 7:
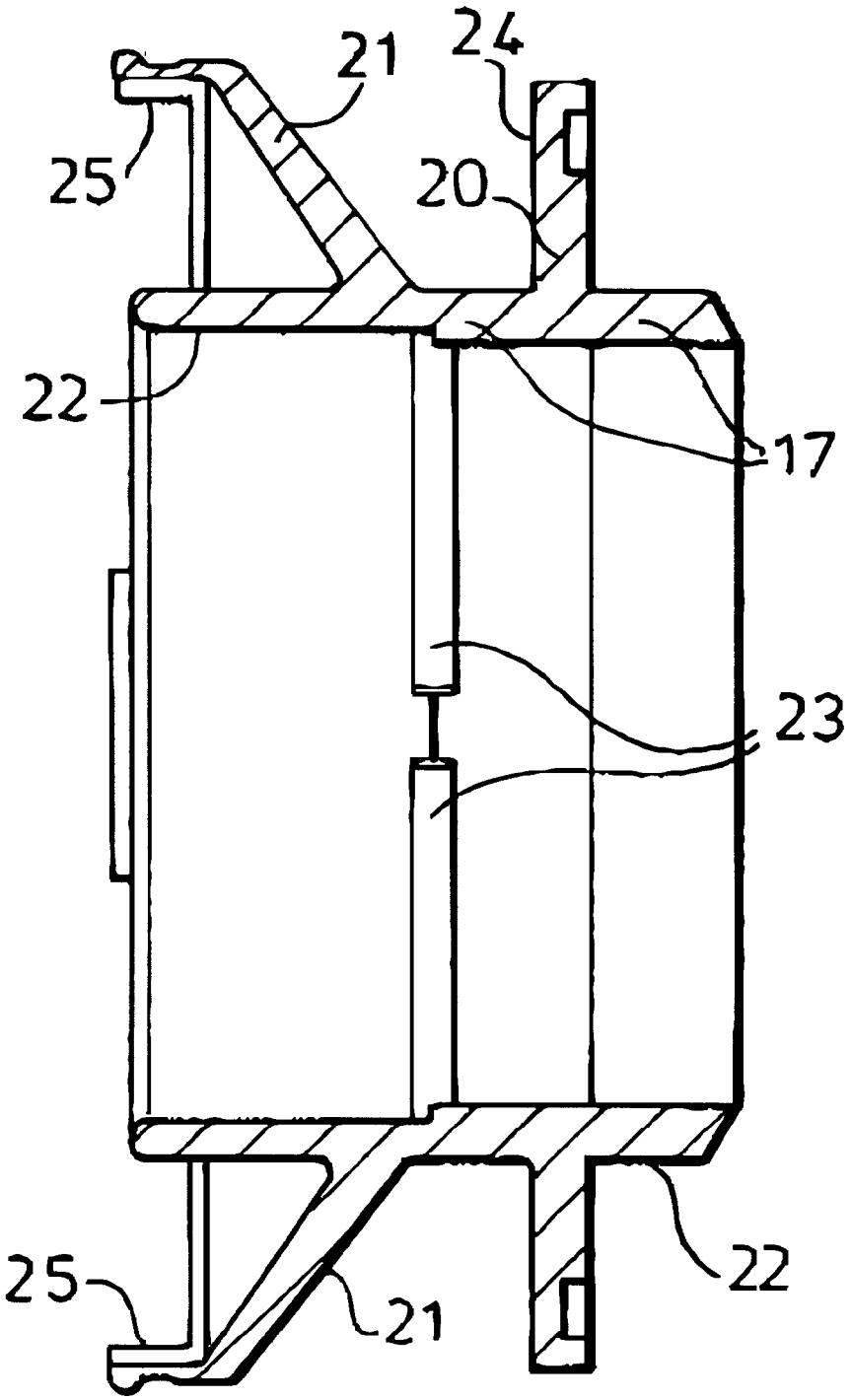
FIG. 7 is a section through the baffle illustrated in FIGS. 5 and 6.
Figure 8:
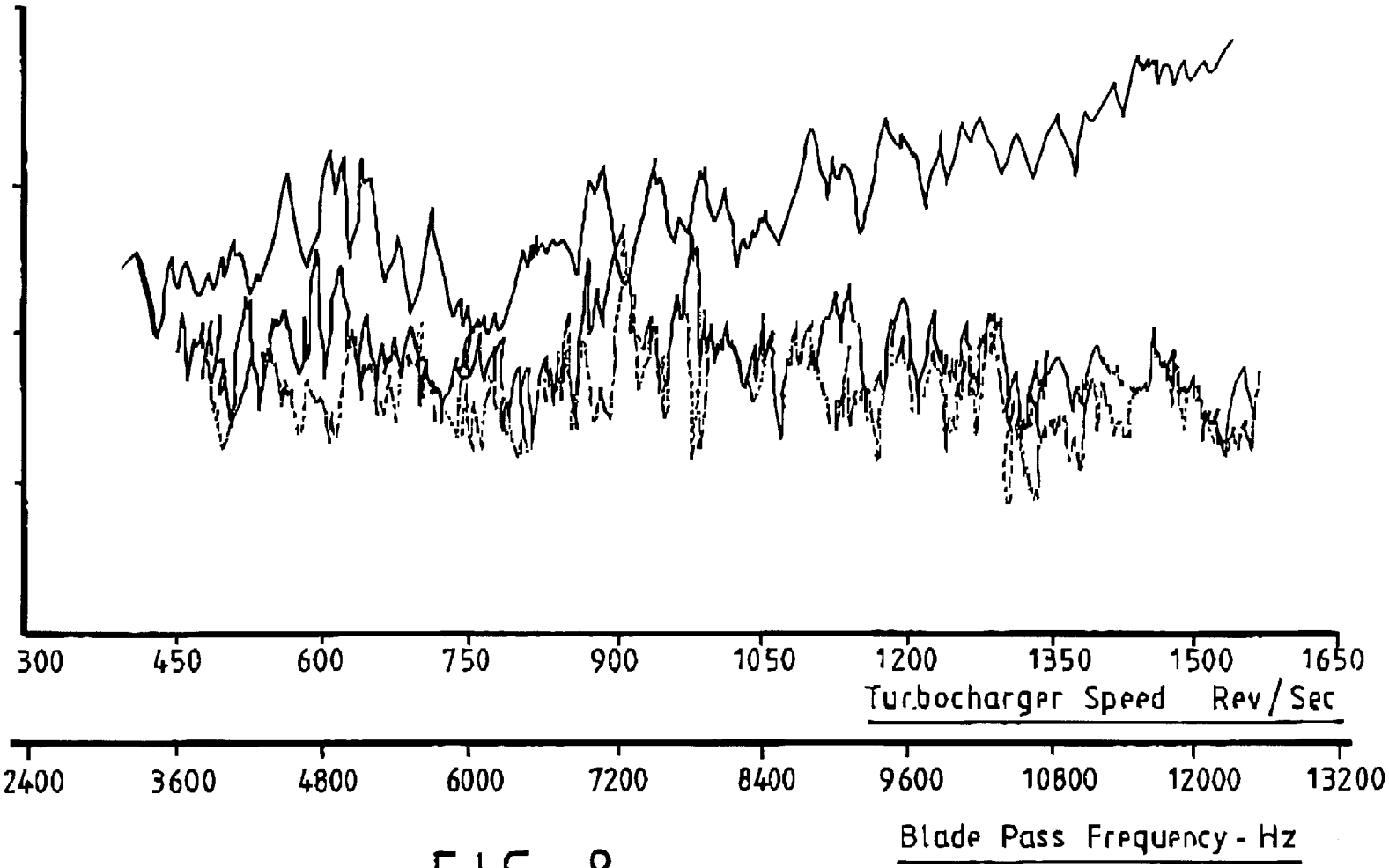
FIG. 8 illustrated the noise output obtained with an inlet structure as illustrated in FIG. 3, an inlet structure as illustrated in FIG. 4, and an inlet structure of the type illustrated in FIG. 4 after removal of a tubular portion of the structure shown in FIG. 4.

Referring to FIG. 8, this illustrates the performance in terms of output noise for three different inlet structures. The upper full line trace represents the weighted sound pressure level resulting from the operation of a turbocharger compressor having an inlet structure as illustrated in FIG. 3. The lower broken-line trace shows the result of replacing the inlet structure of FIG. 3 with the inlet structure as shown in FIGS. 4 to 7. The intermediate full line trace represents the noise level recorded using an inlet structure of the type illustrated in FIGS. 4 to 7 but modified by removal of the fifth portion, that is the tubular extension 22. It will be noted that structures as illustrated in both the modified and unmodified forms result in a substantial reduction in output noise, particularly at the higher frequencies. The best performance is obtained using the unmodified inlet structure as illustrated in FIGS. 4 to 7, but significant improvements are also obtainable using the modified form of that inlet structure, that is without the tubular extension 22.

It is believed that the presence of the apertured wall 20 (the third portion of the inlet structure) significantly reduces the output noise as pressure waves travelling along the annular passage 19 from the slot 18 encounter a reduction in cross-sectional area in the passageway at the wall and then a sudden expansion in that cross-sectional area. Ideally the wall 20 should be at the position of an antinode of a noise wave passing along the annular passageway 19, but the position of antinodes is a function of the frequency of the noise in most applications. An antinode will be located at a distance of one quarter of the wavelength of the noise wave as measured from the slot 18. This frequency varies over a wide range during normal operation of most devices. Experiments have shown that in applications where wide impeller speed (and hence frequency) variations are expected the wall should be positioned approximately midway between the slot 18 and 23. In applications where sustained operation at a predetermined speed is expected, the wall 20 is ideally placed at an antinode of the noise wave to be expected given that operating speed.

As illustrated in FIG. 8, the provision of the wall 20 in the otherwise conventional structure results in a substantial reduction in noise output. A further improvement is achieved by providing the tubular extension 22. It is believed that the inclusion of such an extension is effective because a noise wave passing in the upstream direction encounters a sudden expansion in the cross-sectional area of the passageway along which it is transmitted when it reaches the upstream end of the extension 22. Although not illustrated in FIG. 8, providing the tubular extension 22 even in the absence of the wall 20 provides some reduction in the noise output.

Figure 6:
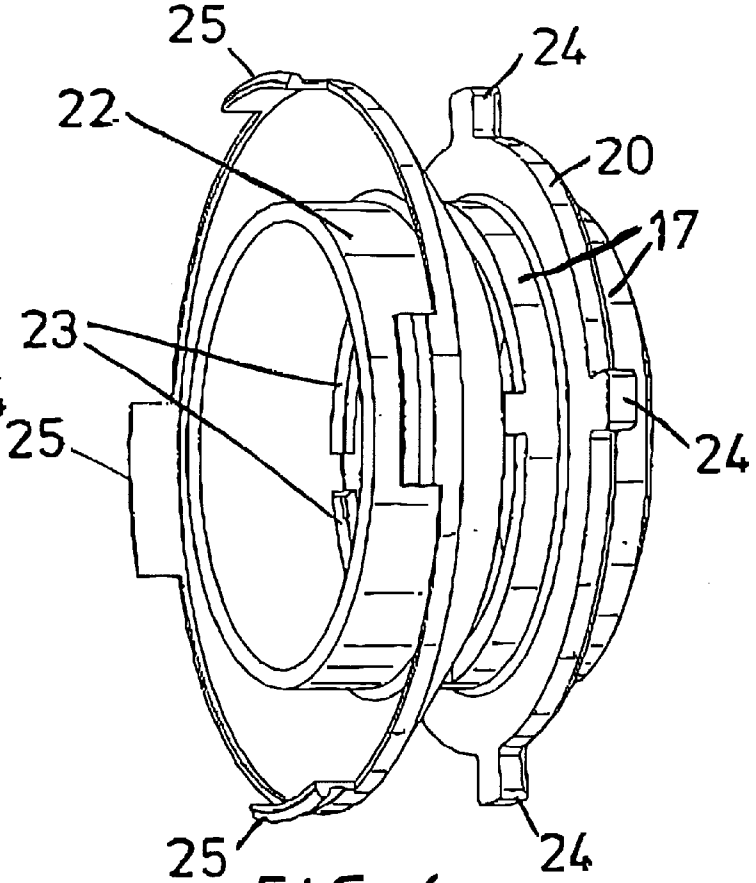
FIGS. 5 and 6 are perspective views of a baffle structure incorporated in the housing illustrated in FIG. 4.
Figure 5:
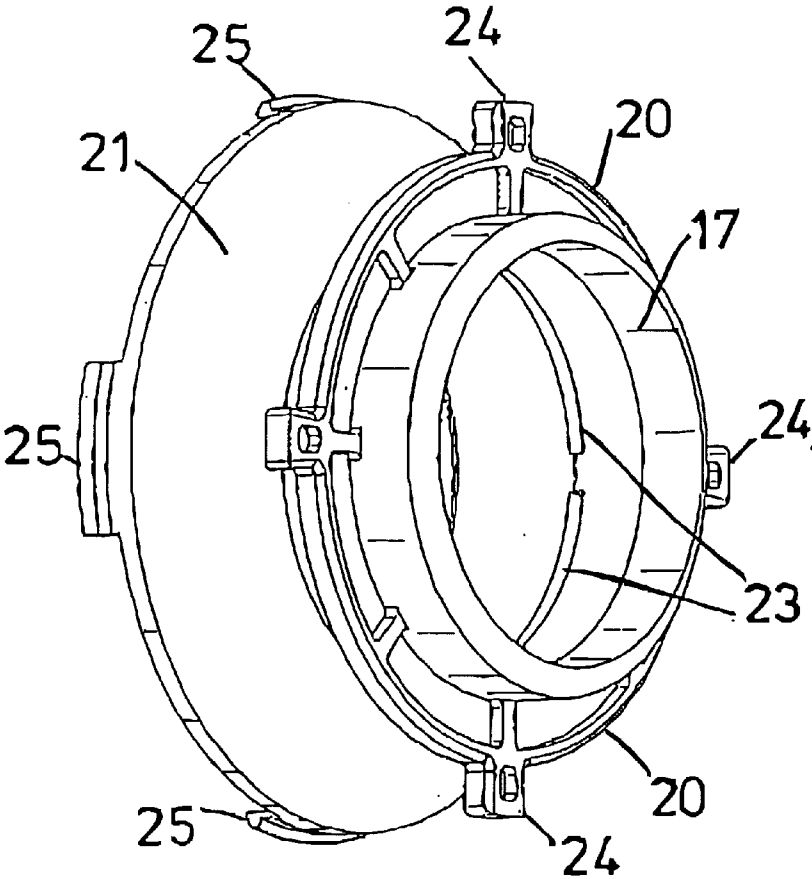

The inlet structure illustrated in FIGS. 5, 6 and 7 may be a single piece moulding or may be an assembly of separately moulded pieces. Generally the assembly will be moulded from plastics material although a metal structure could be used.

The lugs 24 provided on the wall 20 served the purpose of locating the integrally moulded components within the compressor housing. The lugs do not have an aerodynamic or noise reduction function however and can be omitted if alternative arrangements are made to ensure the correct relative location of the various components. Tests have been conducted after removal of the lugs 24 with no measurable increase in output noise.

The inner diameter of the tubular extension 22 is shown to be slightly larger than the inner tubular section 17. Differences between these diameters may affect noise output and aerodynamic performance and selection of the appropriate diameters for these components may be determined experimentally for specific applications. Similarly, the outside diameter of the wall 20, that is the wall 20 without the lugs 24, may be optimised best by experimentation for specific applications.

It will be appreciated that the structure illustrated in FIGS. 5 to 7 could be formed as an assembly of individual moulded components or cast components. For example the wall 20 could be a separate component fitted onto the tubular portion 17. Similarly, the tubular portions 16 and 17 could form part of an integral casting defining an annular passageway into which an annular member defining the wall 20 could be inserted. The conical wall 21 and tubular extension 22 could be formed as a single integral casting or moulding.

Tests have been conducted to assess the importance of providing a conical surface at the end of the annular bypass passageway remote form the impeller wheel. These tests are described with reference to FIGS. 9 to 12.

Figure 9:
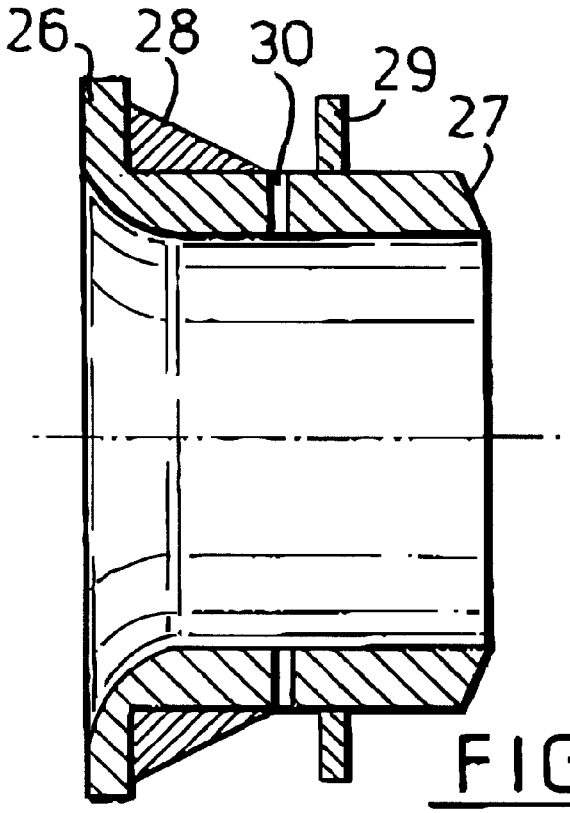
FIG. 9 is a section through an alternative baffle structure which may be incorporated in an embodiment of the present invention.

Referring to FIG. 9, the illustrated sub-assembly was mounted within a tubular inlet to a compressor such that a radially outer surface 26 was engaged against the radially inner surface of a tubular portion of the inlet, an end surface 27 formed one side of a slot which was functionally equivalent to the slot 18 in the arrangement of FIGS. 4 to 7, a conical wall 28 was functionally equivalent to the conical portion 21 of the structure shown in FIGS. 4 to 7, and a radial wall 29 was functionally equivalent to the wall 20 of the arrangement of FIGS. 4 to 7. The assembly also incorporated slots 30 which were functionally equivalent to the slots 23 of the arrangement of FIGS. 4 to 7. In contrast the to the arrangement of FIGS. 4 to 7, the fifth portion of the assembly which is upstream of the slots 30 is not tubular but rather flares outwards towards the surface 26.

Figure 10:
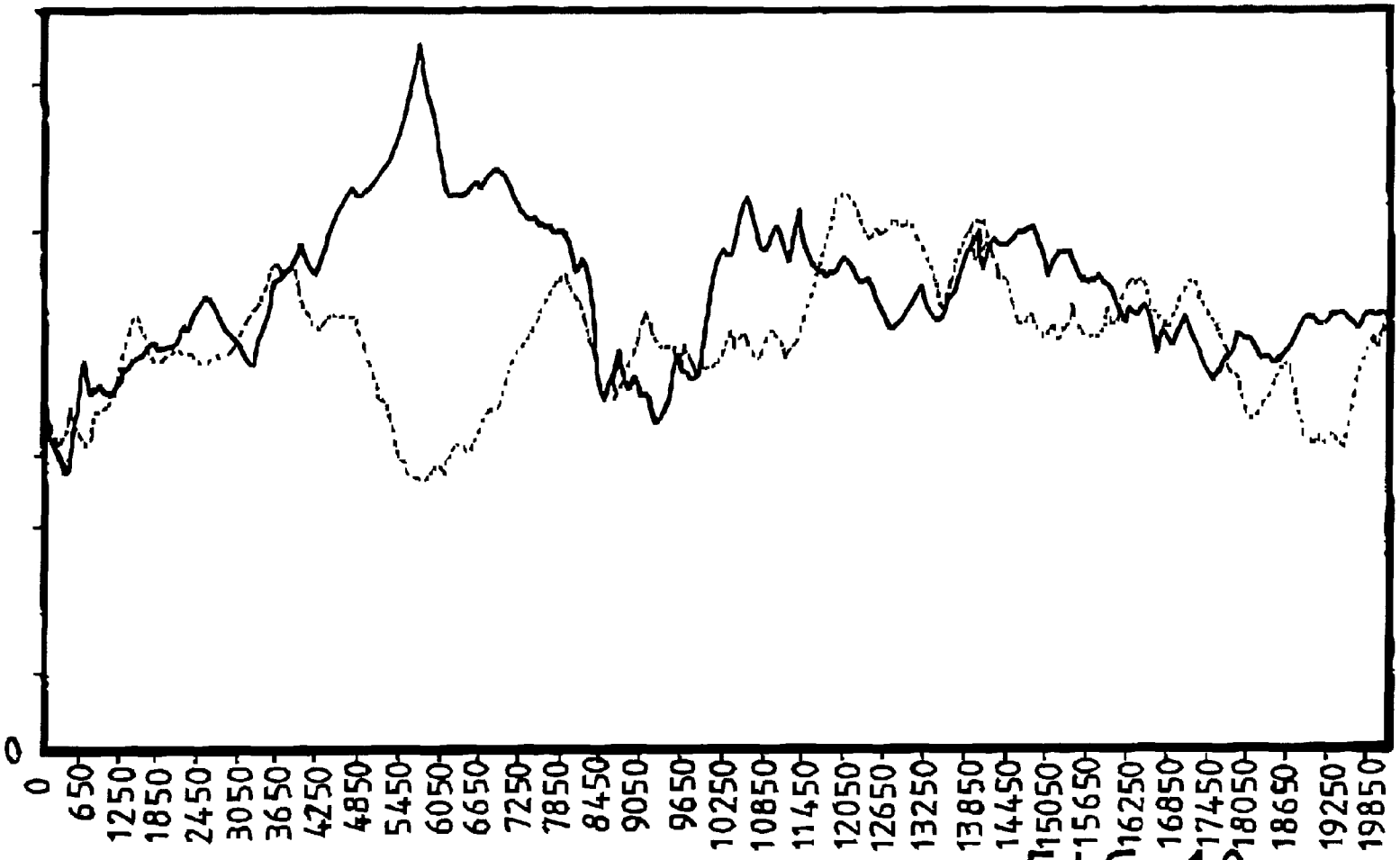
FIG. 10 illustrates the noise output which results from using a baffle of the type shown in FIG. 9.

FIG. 10 illustrates in full line the noise output from a conventional MWE compressor of the type generally illustrated in FIG. 2. It will be noted that the noise output peaks significantly in the 4000 to 8000 hertz range. FIG. 10 also shows in broken line the performance of an MWE input structure incorporating the assembly illustrated in FIG. 9. It will be noted that across the frequency range the two traces overlap but there is a significant reduction in noise output in the 4000 to 8000 frequency range.

Figure 11:
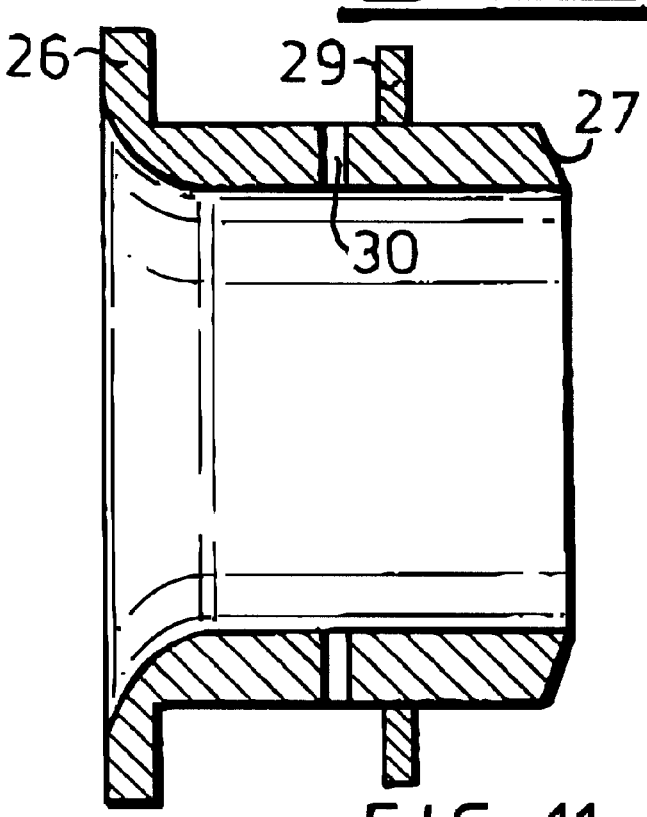
FIG. 11 is a section through a baffle of the type shown in FIG. 9 after removal of an annular portion defining a conical surface.

The assembly of FIG. 9 was formed from three components, that is a flanged tube defining the surfaces 26 and 27 and the slots 30, an annular ring of triangular cross-section defining the conical surface 28, and an annular ring of rectangular cross-section defining the wall 29. Tests were also conducted with a structure identical to that of FIG. 9 except for removal of the annular ring defining the conical surface 28. Such a structure is shown in FIG. 11 and the noise output from that structure is shown in FIG. 12.

Figure 12:
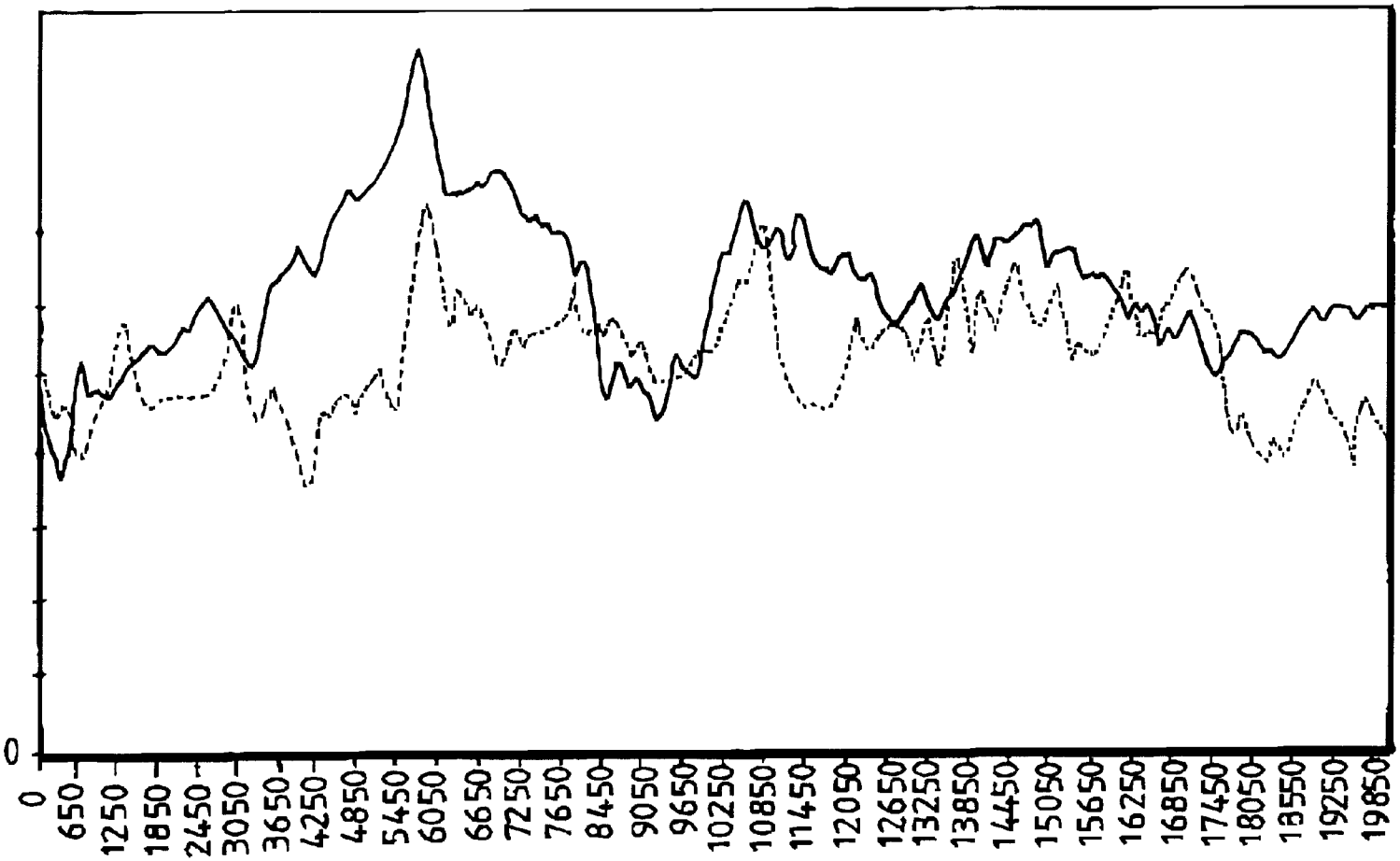
FIG. 12 illustrates the noise output from the compressor inlet incorporating the baffle of FIG. 11.

Referring to FIG. 12 the output of a standard MWE input structure is again shown in full lines. The output from the structure illustrated in FIG. 11 is shown in broken lines. It will be noted that the performance of the device in accordance with FIG. 11 is worse than the performance of the device of FIG. 9, particularly in the 5000 to 7000 hertz range. This indicates that although there is some benefit obtained simply by providing a wall 29 in the annular passage between the two slots of the MWE structure, further benefits are obtained if the end of the annular passage remote from the slots adjacent the impeller wheel is closed off with a conical surface.

The term "conical" has been used in this document to describe surfaces which are truly frusto-conical. It will be appreciated that surfaces which are not truly frusto-conical may also be used, including surfaces which are accurate. A frusto-conical surface is very effective at suppressing noise at a predetermined frequency, and could be used to particular advantage in an application in which the impeller speed is expected to be constant such that noise is propagated at that predetermined frequency. A part-spherical or part elliptical or other curved surface might be used however to better effect in applications where variable impeller speed operation is expected.

Having described the invention, what is claimed as novel and desired to be secured by Letters Patent of the United States is:

What is claimed is:

1. A compressor comprising a housing defining an inlet and an outlet, and an impeller wheel rotatably mounted in the housing such that on rotation of the wheel gas within the inlet is moved to the outlet, the housing having an inner wall defining a surface located in close proximity to radially outer edges of vanes supported by the wheel, wherein the inlet is defined by a first tubular portion an inner surface of which is an extension of the said surface of the inner wall of the housing, a second tubular portion located radially outside the first portion to define an annular passage between the first and second portions, and a wall extending across the annular passage between the first and second tubular portions, the wall being located between upstream and downstream ends of the first tubular portion, sections of the passage on opposite sides of the wall communicating through at least one aperture, and at least one aperture being defined adjacent the wheel in the said surface of the inner wall of the housing to communicate with the annular passage.

2. A compressor according to claim 1, wherein the wall extending across the annular passage is located at or adjacent the position of an anti-node of a noise wave which may be propagated within the annular passageway during use of the compressor.

3. A compressor according to claim 2, wherein the inlet comprises a wall defining an annular surface facing the annular passage and extending outwards from adjacent the upstream end of the first tubular portion to the upstream end of the second tubular portion, an aperture being defined between the upstream end of the first tubular portion and the radially inner edge of the annular surface.

4. A compressor according to claim 3, wherein the annular surface is frusto-conical.

5. A compressor according to claim 4, wherein the surface facing the annular passage extends in the radially outwards and upstream directions from adjacent the upstream end of the first tubular portion.

6. A compressor according to claim 1, wherein the inlet comprises a wall defining a tubular surface extending in the upstream direction from adjacent the upstream end of the first tubular portion.

7. A compressor according to claim 1, wherein the wall extending across the annular passage is in the form of a flange extending radially outwards from the first tubular portion, at least one aperture being defined in radially outer portions of the flange adjacent the second tubular portion.

8. A compressor according to claim 2, wherein at least the first tubular portion and the wall extending across the annular passage are defined by a sub-assembly which is received within the second tubular portion.

9. A compressor according to claim 8, wherein the wall defining an annular surface is defined by the sub-assembly and radially outer portions of the wall defining the annular surface are received in indentations defined within the second tubular portion to secure the sub-assembly in position.

10. A compressor comprising a housing defining an inlet and an outlet, and an impeller wheel rotatably mounted in the housing such that on rotation of the wheel gas within the inlet is moved to the outlet, the housing having an inner wall defining a surface located in close proximity to radially outer edges of vanes supported by the wheel, wherein the inlet is defined by a first tubular portion an inner surface of which is an extension of the said surface of the inner wall of the housing, a second tubular portion located radially outside the first portion to define an annular passage between the first and second portions, a wall defining a surface facing the annular passage and extending from adjacent the upstream end of the first tubular portion to the upstream end of the second tubular portion, and a wall defining a tubular surface extending axially in the upstream direction from the upstream end of the first tubular portion, at least one first aperture being defined between the downstream end of the wall defining the tubular surface and the upstream end of the first tubular portion to communicate with the annular passage, at least one second aperture being defined adjacent the wheel in the said surface of the inner wall of the housing to communicate with the annular passage, an the surface facing the annular passage being inclined to the radial direction.

11. A compressor according to claim 10, wherein the surface facing the annular passage is frusto-conical.

12. A compressor according to claim 11, wherein the surface facing the annular passage extends in the radially outwards and upstream directions from adjacent the upstream end of the first tubular portion.

* * * * *